US005638573A

United States Patent [19]

Martin et al.

[11] Patent Number: 5,638,573

[45] Date of Patent: Jun. 17, 1997

[54] VACUUM CLEANER

[75] Inventors: Michael F. Martin, Bristol, Tenn.; William D. Starr, Bristol, Va.; Peter Hoekstra, Bristol, Tenn.

[73] Assignee: Electrolux Corporation, Atlanta, Ga.

[21] Appl. No.: 453,077

[22] Filed: May 30, 1995

Related U.S. Application Data

[62] Division of Ser. No. 241,579, May 12, 1994, Pat. No. 5,479,676.

[51] Int. Cl.[6] ..... A47L 5/36

[52] U.S. Cl. ..... 15/327.2; 15/327.7

[58] Field of Search ..... 15/327.1, 327.2, 15/327.7

[56] References Cited

U.S. PATENT DOCUMENTS

| | | |
|---|---|---|
| 2,036,058 | 3/1936 | Lang . |
| 2,136,268 | 11/1938 | Watts . |
| 2,198,568 | 4/1940 | Yonkers, Jr. . |
| 2,272,985 | 2/1942 | Smith . |
| 2,300,266 | 10/1942 | Smellie . |
| 2,304,014 | 12/1942 | Paine . |
| 2,498,063 | 2/1950 | Binggely . |
| 2,814,064 | 11/1957 | Montgomery . |
| 2,884,185 | 4/1959 | Dolan . |
| 3,082,938 | 3/1963 | Mott, Jr. . |
| 3,170,184 | 2/1965 | Jepson et al. . |
| 3,334,370 | 8/1967 | Boyd . |
| 3,344,588 | 10/1967 | Szabo . |
| 3,466,696 | 9/1969 | Grellsson . |
| 3,564,641 | 2/1971 | Meyer . |
| 3,599,273 | 8/1971 | Shirayanagi . |
| 3,874,023 | 4/1975 | Tschudy . |
| 3,964,888 | 6/1976 | Hahner et al. . |
| 4,050,913 | 9/1977 | Roach . |
| 4,114,231 | 9/1978 | Nauta . |
| 4,120,616 | 10/1978 | Dwyer et al. . |
| 4,195,969 | 4/1980 | Whitney . |
| 4,280,245 | 7/1981 | Hiester . |
| 4,330,899 | 5/1982 | Miller et al. . |
| 4,334,337 | 6/1982 | Miller et al. . |
| 4,356,591 | 11/1982 | Lude . |
| 4,418,433 | 12/1983 | Fischer . |
| 4,435,877 | 3/1984 | Berfield . |
| 4,462,137 | 7/1984 | Berfield et al. . |
| 4,512,057 | 4/1985 | Laing . |
| 4,512,713 | 4/1985 | Berfield . |
| 4,533,370 | 8/1985 | Ikezaki et al. . |
| 4,547,206 | 10/1985 | Sovis . |
| 4,577,365 | 3/1986 | Yuen . |
| 4,592,764 | 6/1986 | Ikezaki et al. . |
| 4,597,131 | 7/1986 | Lyman . |
| 4,617,034 | 10/1986 | Ikezaki et al. . |

(List continued on next page.)

FOREIGN PATENT DOCUMENTS

| | | |
|---|---|---|
| 35 37 937 | 6/1987 | Germany . |

*Primary Examiner*—Chris K. Moore

*Attorney, Agent, or Firm*—Fish & Neave; Jeffrey H. Ingerman

[57] ABSTRACT

A canister-type vacuum cleaner is provided in which various electrical functions of the vacuum cleaner may be controlled by the user with controls on the hose handle, whether the hose is attached to the suction port or the blowport. The primary exhaust port is located substantially toward the front of the vacuum cleaner body. During normal operation, air is directed from the hose through the suction port and the motor, toward the back of the vacuum cleaner, and then redirected to the front of the vacuum cleaner, where it exits from the primary exhaust port. The vacuum cleaner is also provided with a reduced wheelbase, for greater maneuverability. Two wheels are mounted on the underside of the vacuum cleaner body, near the vacuum cleaner's center of gravity, and a caster is mounted near the front of the vacuum cleaner. The vacuum cleaner can therefore be rotated about an axis passing adjacent the cleaner's center of gravity and perpendicular to the surface being cleaned, as well as an axis passing between the two wheels. Additional casters may be mounted on the underside and toward the back of the vacuum cleaner body, for additional stability.

5 Claims, 12 Drawing Sheets

FIG. 4

U.S. PATENT DOCUMENTS

| | | |
|---|---|---|
| 4,651,380 | 3/1987 | Ogden . |
| 4,654,924 | 4/1987 | Getz et al. . |
| 4,655,694 | 4/1987 | Berfield . |
| 4,679,990 | 7/1987 | Yamaura . |
| 4,693,734 | 9/1987 | Erickson, Jr. . |
| 4,706,326 | 11/1987 | Romani . |
| 4,733,429 | 3/1988 | Jacob . |
| 4,733,430 | 3/1988 | Westergren . |
| 4,735,555 | 4/1988 | Erickson, Jr. . |
| 4,773,118 | 9/1988 | Lindquist et al. . |
| 4,797,072 | 1/1989 | Berfield et al. . |
| 4,864,683 | 9/1989 | Herron Jr. . |
| 4,938,309 | 7/1990 | Emdy . |
| 4,970,753 | 11/1990 | Herron, Jr. . |
| 5,068,555 | 11/1991 | Oberdorfer-Bogel . |
| 5,110,266 | 5/1992 | Toyoshima et al. . |
| 5,155,876 | 10/1992 | Whitaker . |
| 5,159,738 | 11/1992 | Sunagawa et al. . |
| 5,214,822 | 6/1993 | Sakurai et al. . |
| 5,547,206 | 8/1996 | Sovis et al. . |

VACUUM CLEANER

This is a division, of application Ser. No. 08/241,579, filed May 12, 1994 now U.S. Pat. No. 5,479,676, issued Jan. 2, 1996, entitled VACUUM CLEANER.

BACKGROUND OF THE INVENTION

This application relates to vacuum cleaners. More particularly, this application relates to canister vacuum cleaners that are pulled along the ground by a hose and have a suction port and an exhaust port.

Canister vacuum cleaners typically have an elongated casing that houses a motor, a blower powered by the motor to create suction, and a receptacle to capture and store dirt drawn into the vacuum cleaner. The dirt is sucked in with air through a suction opening. Typically, a hose is attached to the opening and is directed to the areas to be cleaned. One or more attachments may be provided to use on the end of the hose to clean different types of surfaces.

The hose is also used to pull the vacuum cleaner along the floor. In that connection, the vacuum cleaner is usually provided with wheels. The wheel closest to the front (the end at which the hose is attached) is usually part of a caster that allows steering of the direction of the wheel, so that the vacuum cleaner more easily follows the direction in which it is pulled by the hose. However, the rear wheels are usually adjacent the opposite end, forming a long wheelbase that makes it difficult to maneuver the vacuum cleaner in tight spaces—e.g., vestibules and staircase landings, and around furniture.

It is known to provide a switch for the vacuum cleaner on a handle at the end of the hose, so that the user can turn the vacuum cleaner on or off without having to return to the canister body. The switch may be the only switch, or may be an auxiliary switch, with another switch on the canister. Appropriate conductors in the hose are connected by appropriate connectors in the hose end to mating connectors in the suction port.

It is also known to provide exhaust ports, or "blowports," on canister vacuum cleaners, to which the hose can be attached when a source of positive air pressure is needed. Such a blowport can also be used in some cases to clear a blocked hose. However, on vacuum cleaners in which the switch is in the hose handle, there has not heretofore been provided a blowport having the necessary electrical connections to allow the vacuum cleaner to be controlled by the hose handle switch. In a vacuum cleaner in which the only switch is in the handle, that has meant that such vacuum cleaners could not have useful blowports (i.e., blowports to which hoses could be attached).

Vacuum cleaners have traditionally been relatively noisy. It has been known to provide alternate airflow paths (with an appropriate diverter valve), so that if a blowport (which is relatively narrow and thus increases noise) is not being used, the exhaust air is directed to a larger exhaust vent that allows the air to diffuse and reduces the noise produced. However, the ability to provide sufficiently large vents is limited by the fact that the airflow path is almost always substantially linear, extending from the suction opening to the blower and beyond the blower to the exhaust port or vent. Thus only the area behind the blower (on the far side of the blower from the suction port) has been available for the blowport and the exhaust vent, limiting the size of the vent.

Thus, it would be desirable to be able to increase the size of a vacuum cleaner exhaust vent, thereby decreasing the volume of the noise produced by the vacuum cleaner.

It would also be desirable to be able to provide a blowport with electrical connections so that a switch on the hose can be used to control the vacuum cleaner when the hose is connected to the blowport.

It would further be desirable to be able to provide a vacuum cleaner having a reduced wheelbase for greater maneuverability.

SUMMARY OF THE INVENTION

It is an object of the present invention to increase the size of a vacuum cleaner exhaust vent, thereby decreasing the volume of the noise produced by the vacuum cleaner. This is accomplished by directing the exhaust from the blower toward the front end, where there is room to provide a larger vent, with the blowport being in the smaller area toward the rear end.

It is also an object of the present invention to provide a blowport with electrical connections so a switch on the hose can be used to control the vacuum cleaner when the hose is connected to the blowport.

It is a further object of the present invention to provide a vacuum cleaner having a reduced wheelbase for greater maneuverability.

In accordance with the present invention, there is provided a vacuum cleaner having a blower for creating suction, an electric motor driving the blower, a suction port, an exhaust port, and a suction passage. The suction passage comprises a first leg extending from the suction port to the electric motor and the blower, and a second leg extending from the electric motor and the blower to the exhaust port in a direction toward the suction port.

In addition, there is provided a vacuum cleaner having a blower for creating suction, an electric motor for driving said blower, an electric motor actuation circuit electrically connected to said electric motor, a dirt collection container, a body housing the electric motor, the electric motor actuation circuit and the dirt collection container, and a hose connected at a first end thereof to the body. The hose has a handle at a second end thereof, and the handle has a control for actuating the motor, the hose further having hose conductors connected to the control and extending to the first end, and first electrical contact members connected to the hose conductors at the first end. The body comprises a suction port, an exhaust port, and a suction passage extending therethrough from the suction port to the exhaust port. Each of the suction port and the exhaust port comprises respective second electrical contact members for mating with the first electrical contact members when the hose is connected to a respective one of the suction port and the exhaust port. The respective second electrical contact members are connected to the electric motor actuation circuit for actuating the motor in response to user actuation of the control.

Finally, there is provided a vacuum cleaner comprising a body having a front end from which the body is pulled along a surface on which it rests, a rear end opposite the front end, a center of gravity between the front end and the rear end, an underside adjacent the surface, a longitudinal axis running from the front end to the rear end, a steering axis adjacent the front end and substantially perpendicular to the longitudinal axis, and a main wheel axis substantially perpendicular to the longitudinal axis, substantially parallel to the surface, and adjacent the center of gravity. At least two wheels are mounted on the underside of the body for rotation about the main wheel axis, each of the wheels being mounted in a respective wheel plane substantially perpendicular to the main wheel axis. A caster is mounted on the underside of the body for rotation about the steering axis, the caster having a caster wheel axis perpendicular to the steering axis and having a caster wheel mounted for rotation about the caster wheel axis. When the vacuum cleaner is pulled parallel to the surface in a direction oblique to the longitudinal axis, the body pivots about a pivot axis substantially parallel to the steering axis and passing through the main wheel axis.

BRIEF DESCRIPTION OF THE DRAWINGS

The above and other objects and advantages of the invention will be apparent upon consideration of the following detailed description, taken in conjunction with the accompanying drawings, in which like reference characters refer to like parts throughout, and in which.

DETAILED DESCRIPTION OF THE INVENTION

The present invention is a canister-type vacuum cleaner, designed for normal, household operation. As with previous vacuum cleaners of this type, the present vacuum cleaner is designed to normally be pulled along the ground by a hose attached to a suction port.

The vacuum cleaner of the present invention is provided with an electrical hose that may be attached to either a suction port, to provide suction, or to a blowport, to provide a source of pressurized air. The user can control various functions of the vacuum cleaner through controls located on the far end of the hose—i.e., the end of the hose that does not plug into the ports—regardless of whether the hose is attached to the suction port or to the blowport. Both ports are provided with electrical connectors to facilitate such controls.

The primary exhaust port of the vacuum cleaner of the present invention is located near the front end of the canister, preferably substantially above the suction port. During normal operation of the vacuum cleaner, the blowport, located near the back of the canister, is automatically closed, and exhaust air is directed from the blower toward the front of the cleaner, where a larger exhaust vent is provided. Consequently, the noise produced by the cleaner is significantly reduced.

The vacuum cleaner of the present invention has been made more maneuverable through a unique caster and wheel arrangement. Two or more wheels are located on the underside of the canister, adjacent the vacuum cleaner's center of gravity and away from its rear end. A caster is located on the underside of the canister, toward the front end. This shortens the wheelbase of the vacuum cleaner, providing increased maneuverability so that the vacuum cleaner body may be rotated in smaller spaces. Two or more additional wheels or casters may be located on the underside of the canister, such as toward the rear end, to provide additional stability in the event the user exerts pressure on that end of the vacuum cleaner.

Figure 1:
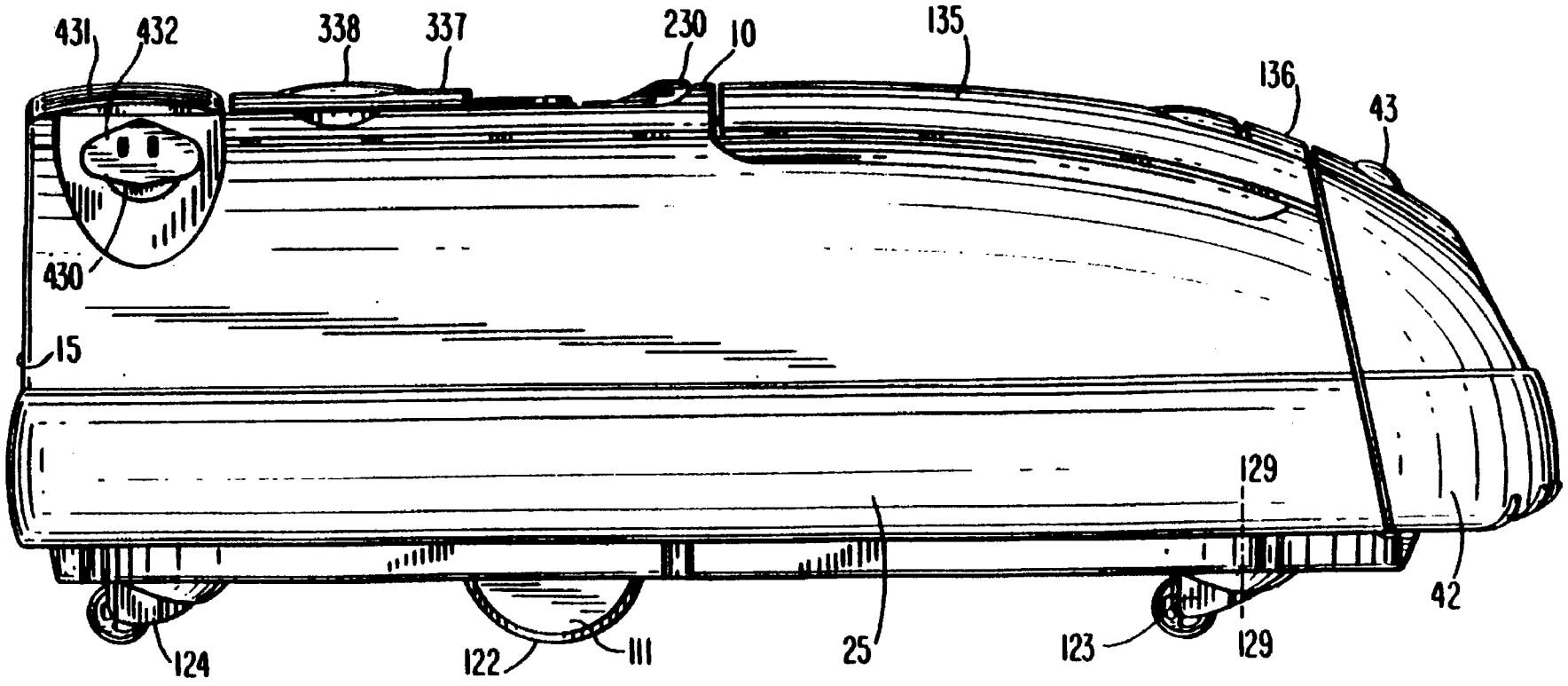
FIG. 1 is a left side elevational view of a vacuum cleaner body constructed according to the present invention.
Figure 3:
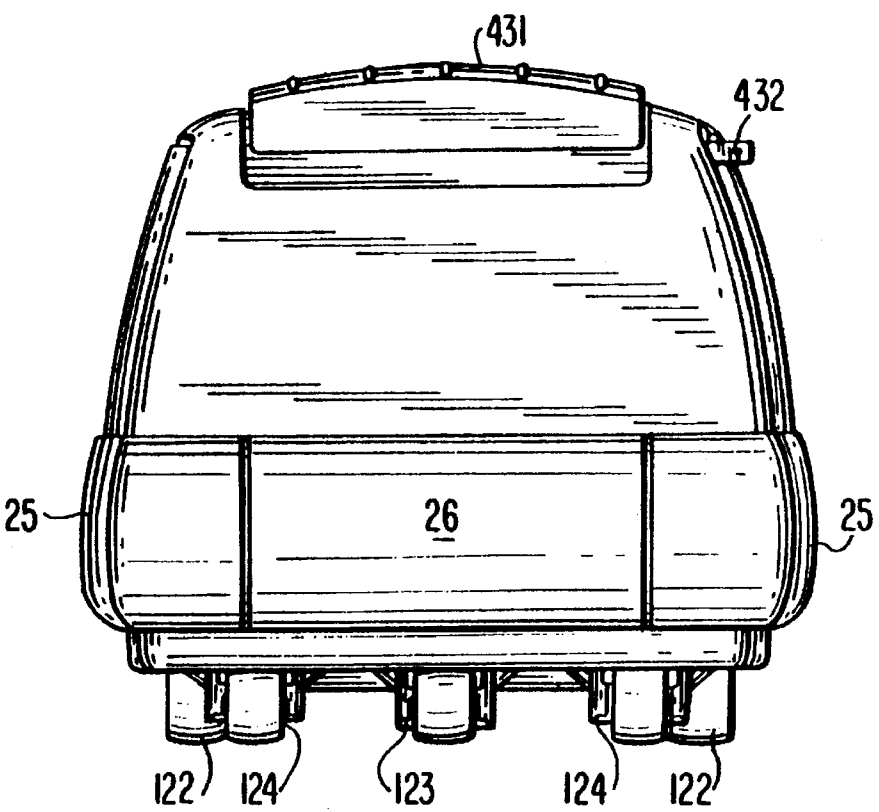
FIG. 3 is a rear view of the vacuum cleaner body of FIGS. 1 and 2.
Figure 2:
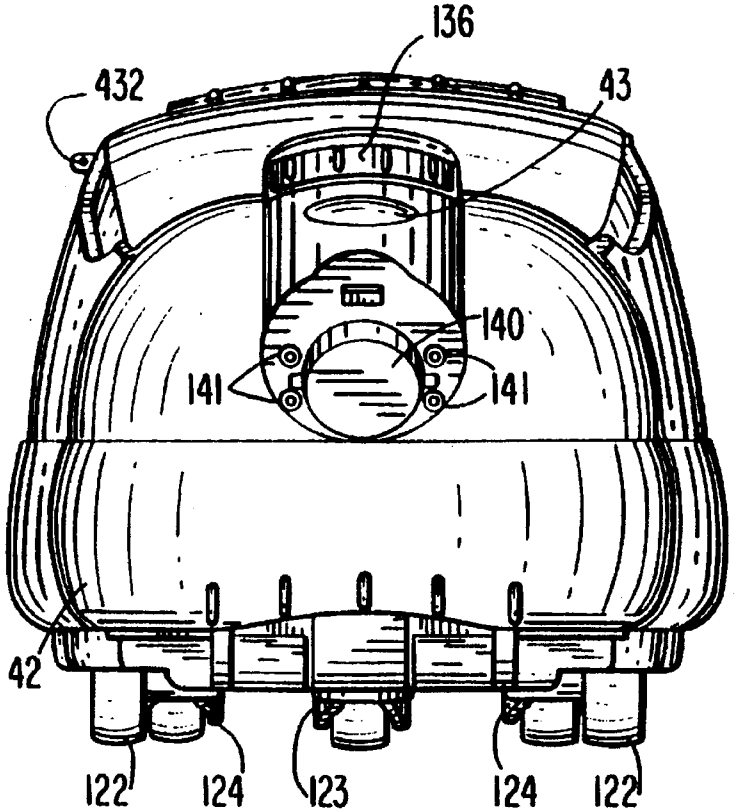
FIG. 2 is a front view of the vacuum cleaner body of FIG. 1.
Figure 4:
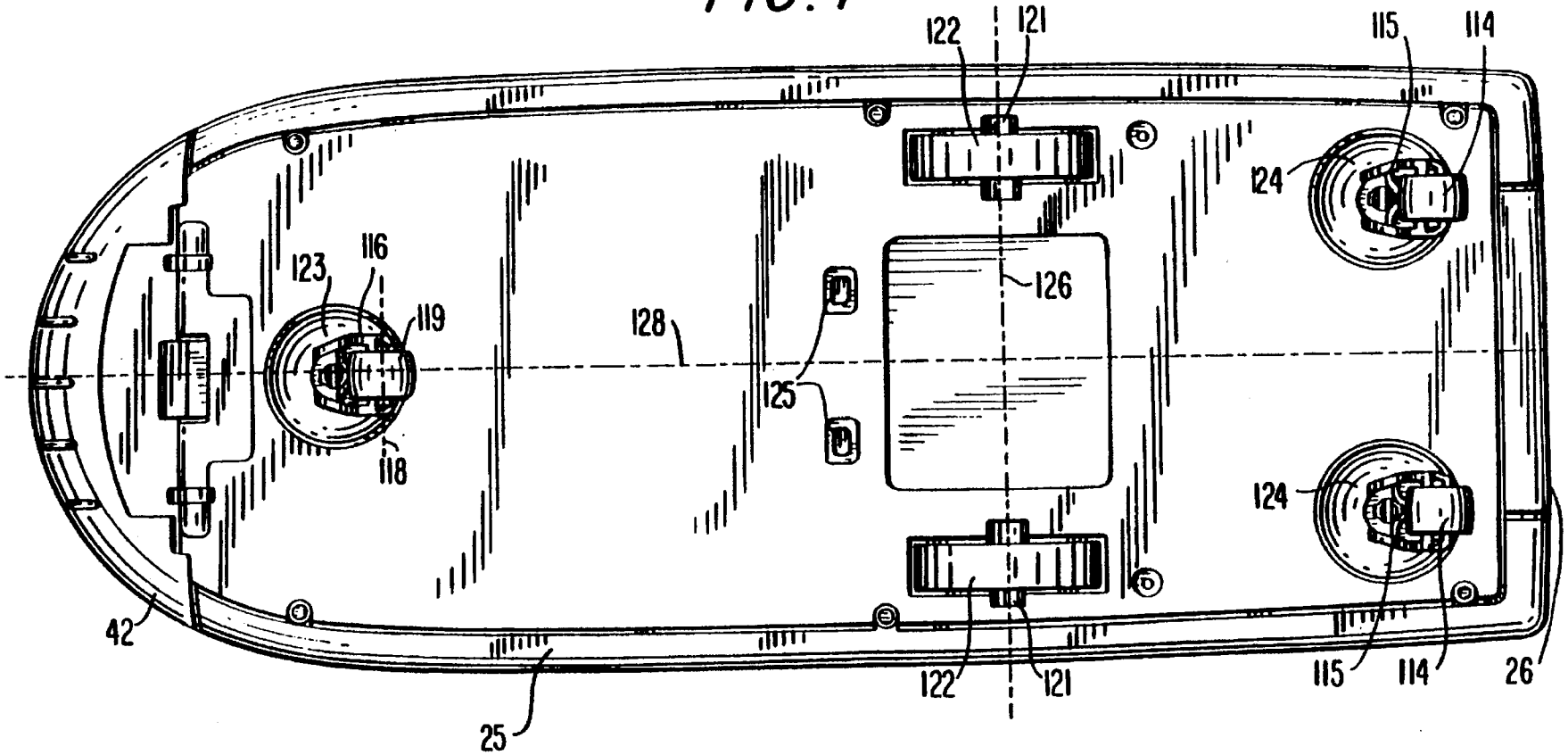
FIG. 4 is a bottom plan view of the vacuum cleaner body of FIGS. 1–3.
Figure 5:
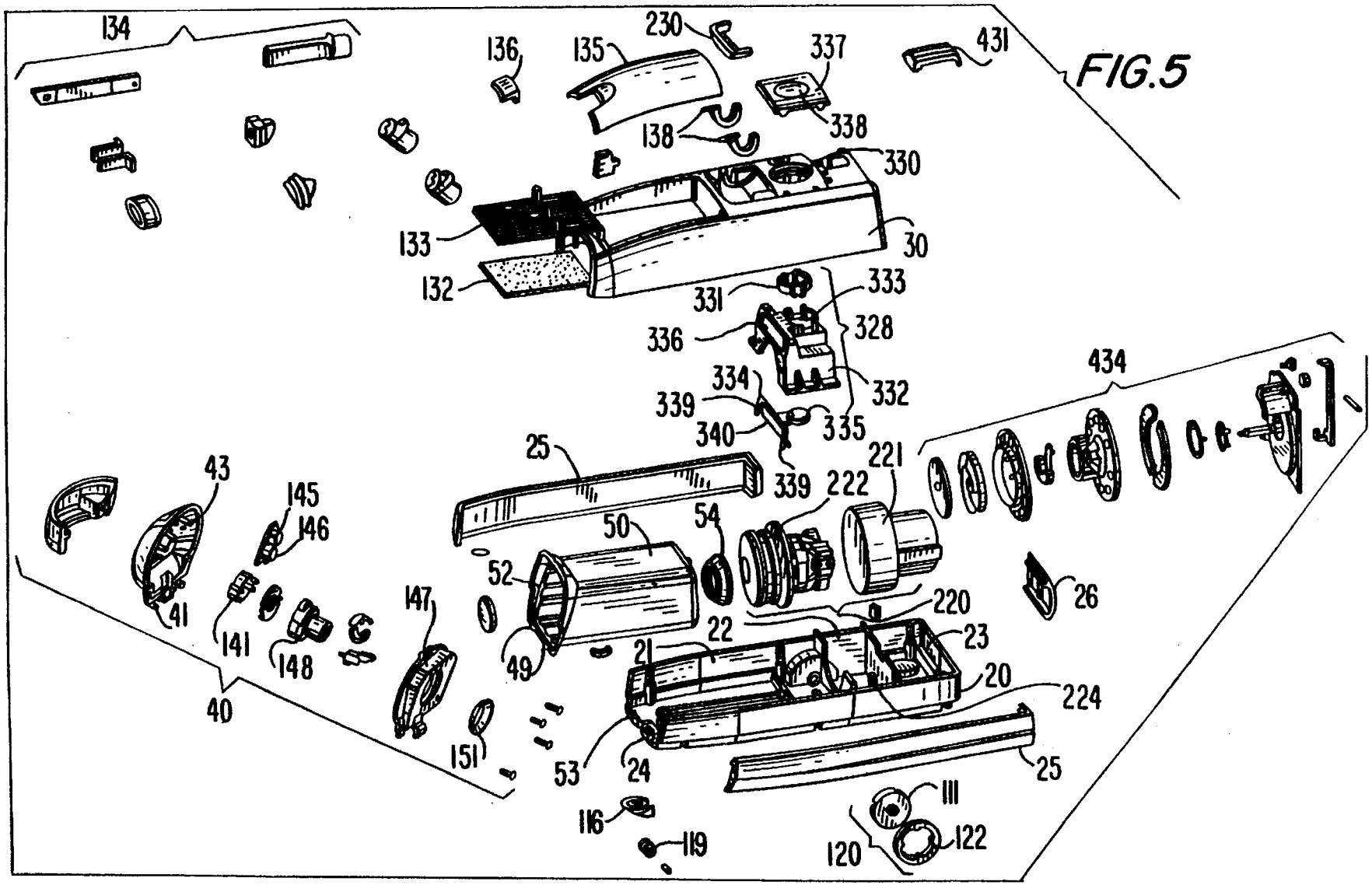
FIG. 5 is an exploded view of the vacuum cleaner body of FIGS. 1–4.
Figure 6:
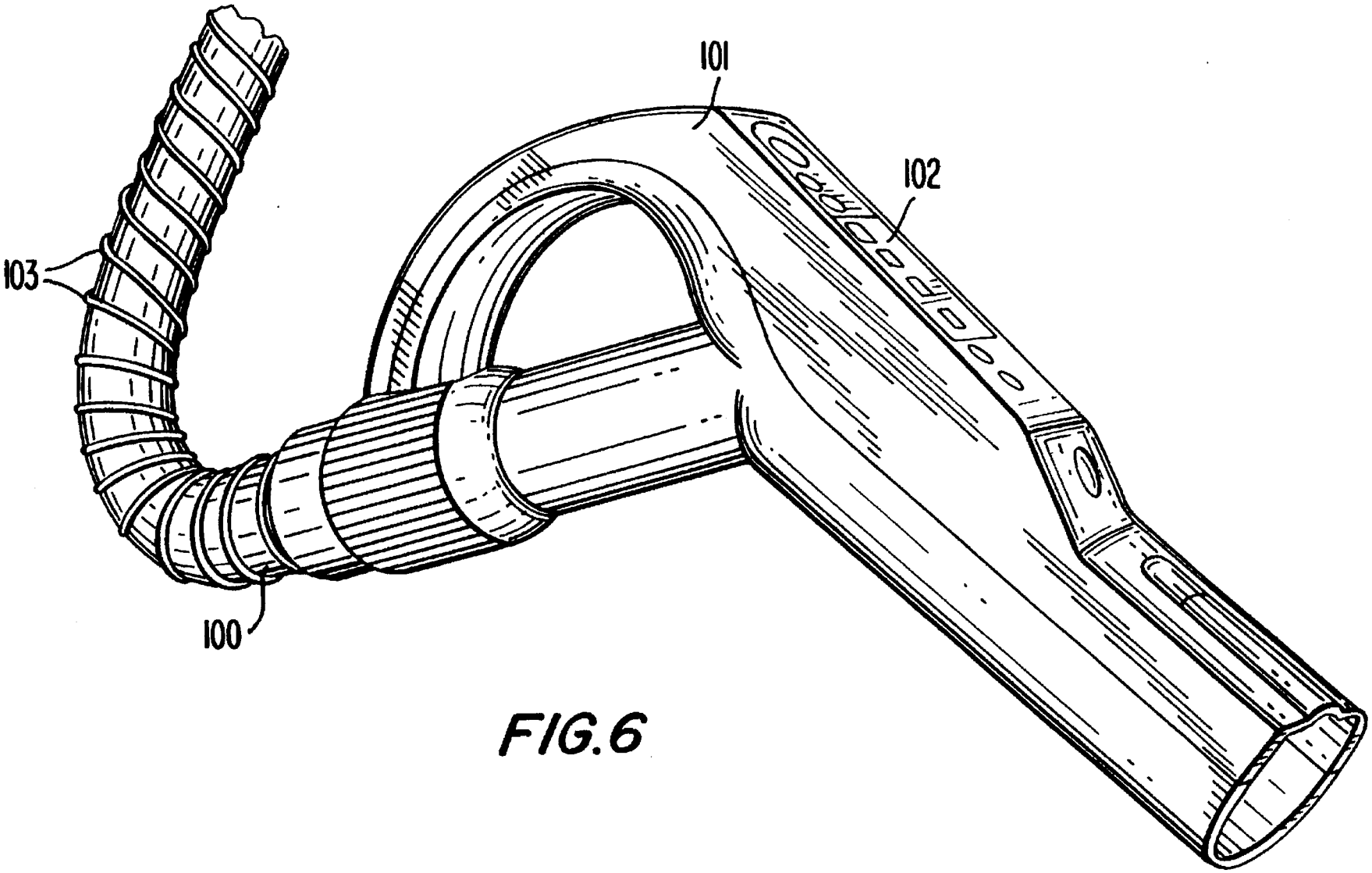
FIG. 6 is a perspective view of the handle end of a hose assembly according to the present invention.

Referring now to FIGS. 1–13, a canister-type vacuum cleaner 10 according to the present invention preferably comprises a main vacuum cleaner body 15, illustrated in FIGS. 1–5, and a hose assembly 100, shown in FIG. 6. As seen in FIG. 5, vacuum cleaner body 15 preferably comprises a lower shell 20, an upper shell 30, a front door assembly 40, an innerbody 50, and a motor assembly 220.

Turning now to the construction of body 15, upper shell 30, preferably made from molded ABS, preferably does not contain any electrical wiring. Any electrical connections in body 15 are made in lower shell 20 or front door assembly 40. Upper shell 30 can simply be attached to lower shell 20, simplifying final assembly of body 15.

Figure 11:
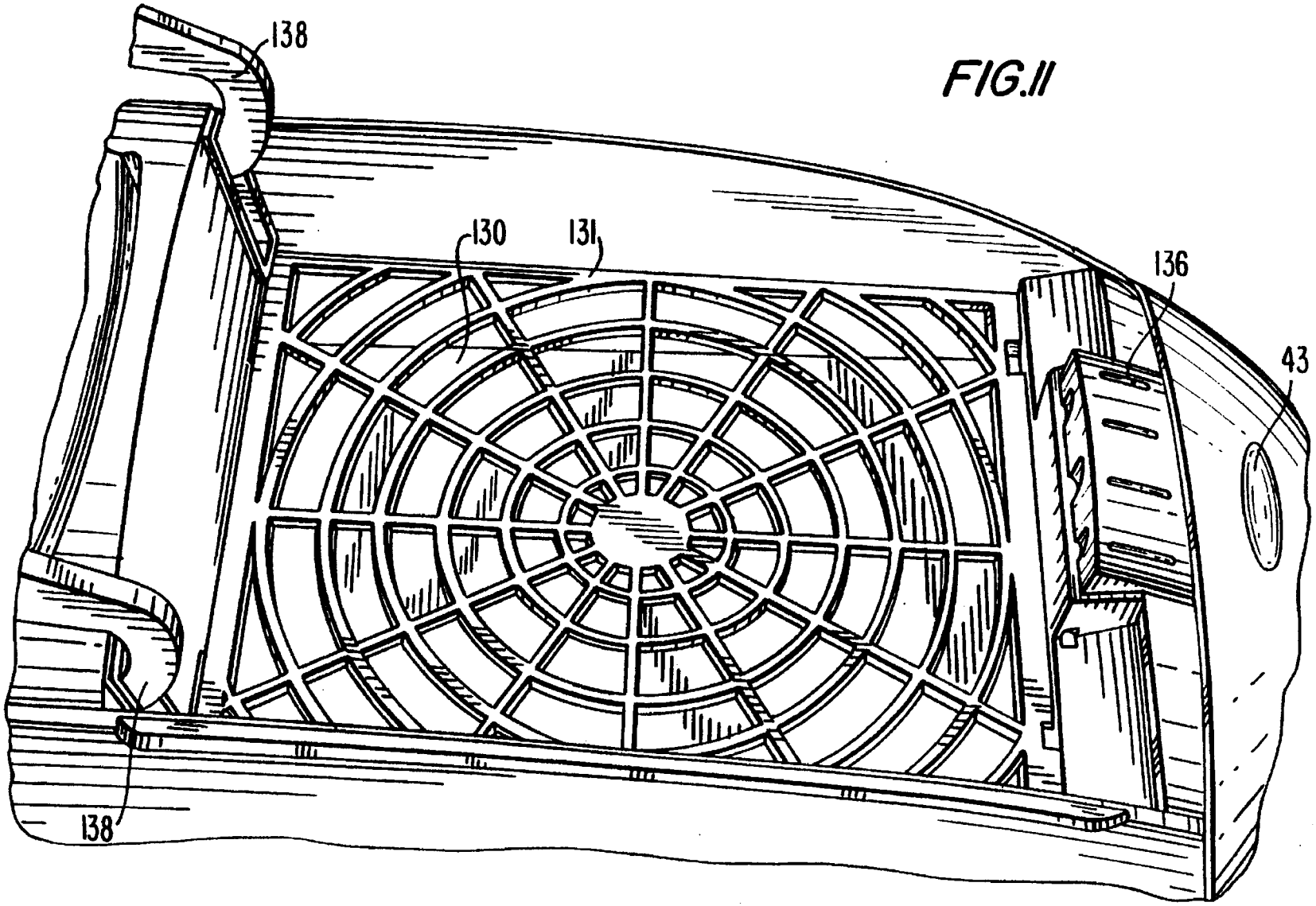
FIG. 11 is a perspective view of the exhaust cavity of the vacuum cleaner of FIGS. 1–5, with the cavity cover opened.
Figure 12:
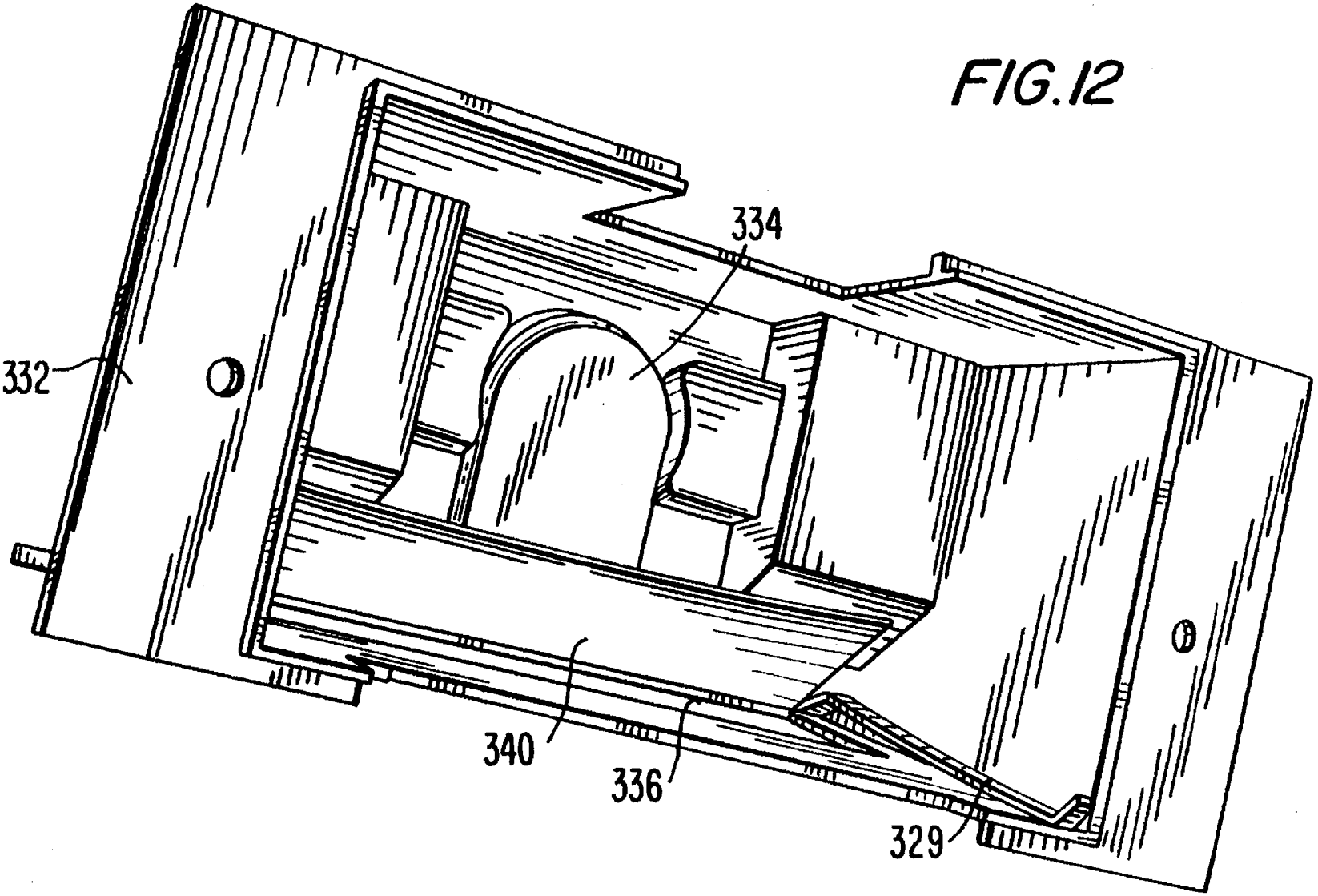
FIG. 12 is a perspective view of the inside of the outer motor cowl of the vacuum cleaner of FIGS. 1–5.

As shown in FIG. 5, the front portion of upper shell 30 forms an exhaust cavity 130. A filter 132, preferably made from melt-blown polypropylene, is preferably placed on top of, and covers, bottom 131 of exhaust cavity 130 (shown in FIG. 11), and an accessory tool grill 133 sits on top of filter 132. The bottom 131 of cavity 130, shown in FIG. 11, is preferably molded into a grid, to provide support for filter 132, grill 133 and hose attachments 134. An assortment of conventional vacuum cleaner attachments 134, for use with hose 100, may be stored in exhaust cavity 130 on top of grill 133.

Cavity 130 serves as an expansion chamber for the exhaust air, which reduces noise. A cavity cover 135 comprises hinges 138, integrally formed in the rear of both of its sides, which are designed to snap into openings formed in shell 30, serving to close cavity 130. Cover 135 keeps accessories 134, grill 133 and filter 132 in place during use of the vacuum cleaner, while still allowing the exhaust of air around its edges. Access to attachments 134, grill 133 and filter 132 is achieved by opening cover 135.

Behind cavity cover 135 on shell 30 is a handle 230, which lies flush with the upper surface of shell 30 during normal operation of vacuum cleaner 10. Handle 230 preferably snaps into openings formed in shell 30. Preferably, no screws or other fasteners are used to connect handle 230 to shell 30. Handle 230 is preferably located substantially above the center of gravity of vacuum cleaner body 15 so that body 15 remains substantially horizontal when lifted by handle 230.

Figure 13:
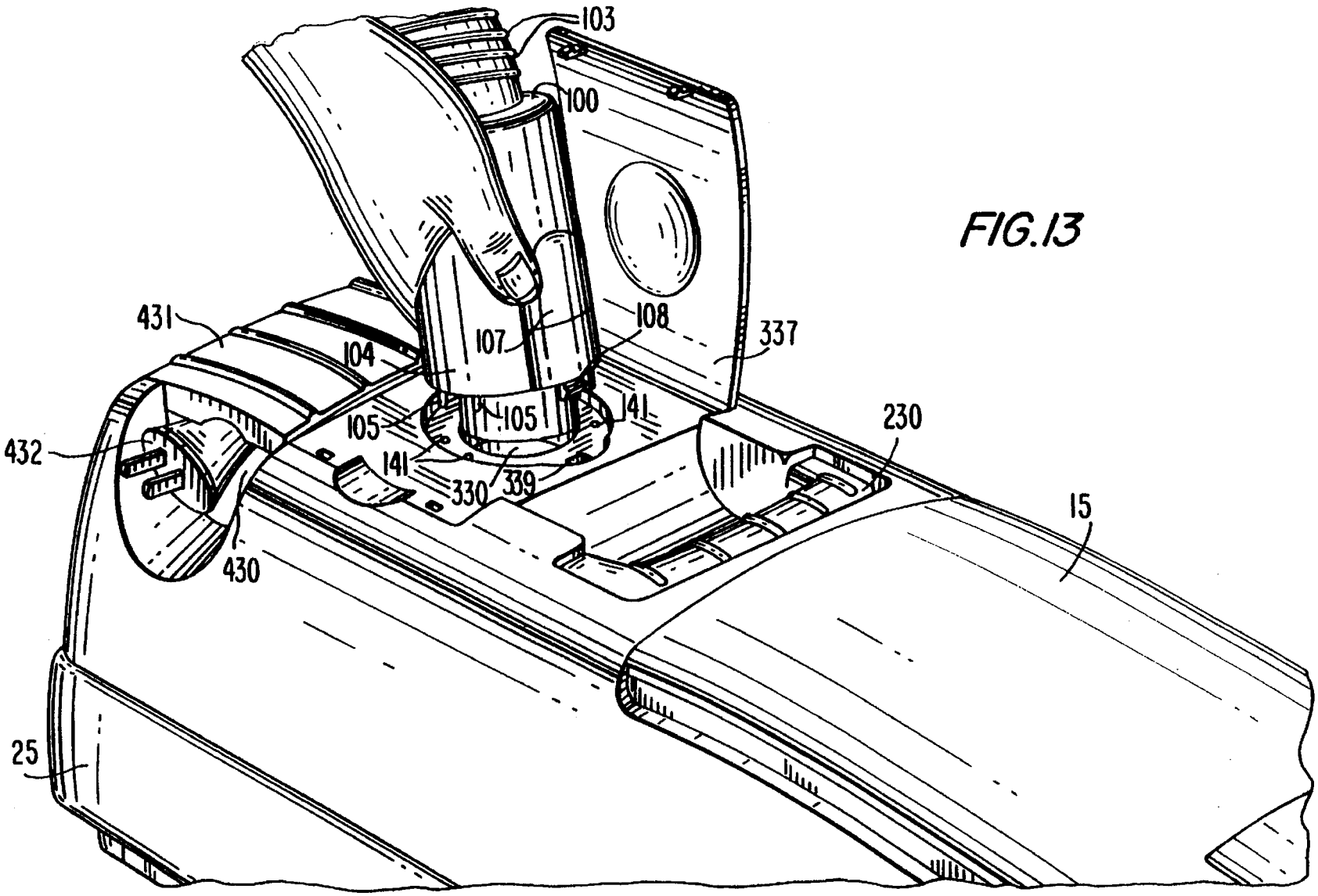
FIG. 13 is a perspective view of the other end of the hose assembly of FIG. 6 and the back portion of the vacuum cleaner of FIGS. 1–5.

Also formed in upper shell 30, behind handle 230, is a blowport 330, illustrated in FIGS. 5 and 13. Blowport 330 is provided with female electrical connectors 141 for attachment to the male electrical connectors 105 provided in one end of hose 100. Connectors 141 for blowport 330 are preferably provided without the need for electrical wiring in upper shell 30. Instead, an electrical contact ring 331, illustrated in FIG. 5, with two sets of two female electrical connectors 141 located on opposite sides of ring 331, sits on top of outer cowl 332. When vacuum cleaner 10 is completely assembled, outer cowl 332 and contact ring 331 are urged against the underside of blowport 330.

Immediately behind blowport cover 337, on shell 30, and raised substantially from the bottom of vacuum cleaner 10, is power cord opening 430. A cord rewinding lever 431 is located on top of shell 30, also behind cover 337, and adjacent opening 430.

Power cord 433 may be wound completely around a speed-governed cord reel assembly 434, located underneath lever 431, and illustrated in FIG. 5, with plug 432 lying against and protruding slightly from the side of shell 30.

As can be seen in FIG. 5, assembly 434 is mounted vertically inside shells 20, 30. When vacuum cleaner 10 is to be used, cord 433 may be sufficiently unwound to allow operation of vacuum cleaner 10 over the intended area. After use of vacuum cleaner 10, and after plug 432 has been removed from the electrical socket, rewind lever 431, which is biased outward by one or more flat-wire springs, may be depressed, and cord 433 will be automatically rewound by assembly 434. Because assembly 434 is speed-governed, cord 433 is prevented from lashing over the top of vacuum cleaner 10. Cord 433 will not rewind until rewind lever 431 is depressed.

Lower shell 20 is preferably molded so as to provide three separate compartments: an innerbody compartment 21, a motor compartment 22, and a power cord compartment 23. Lower shell 20 is preferably formed from molded polypropylene, which is known to be inherently sound-absorbent, resulting in quieter operation.

Figure 10:
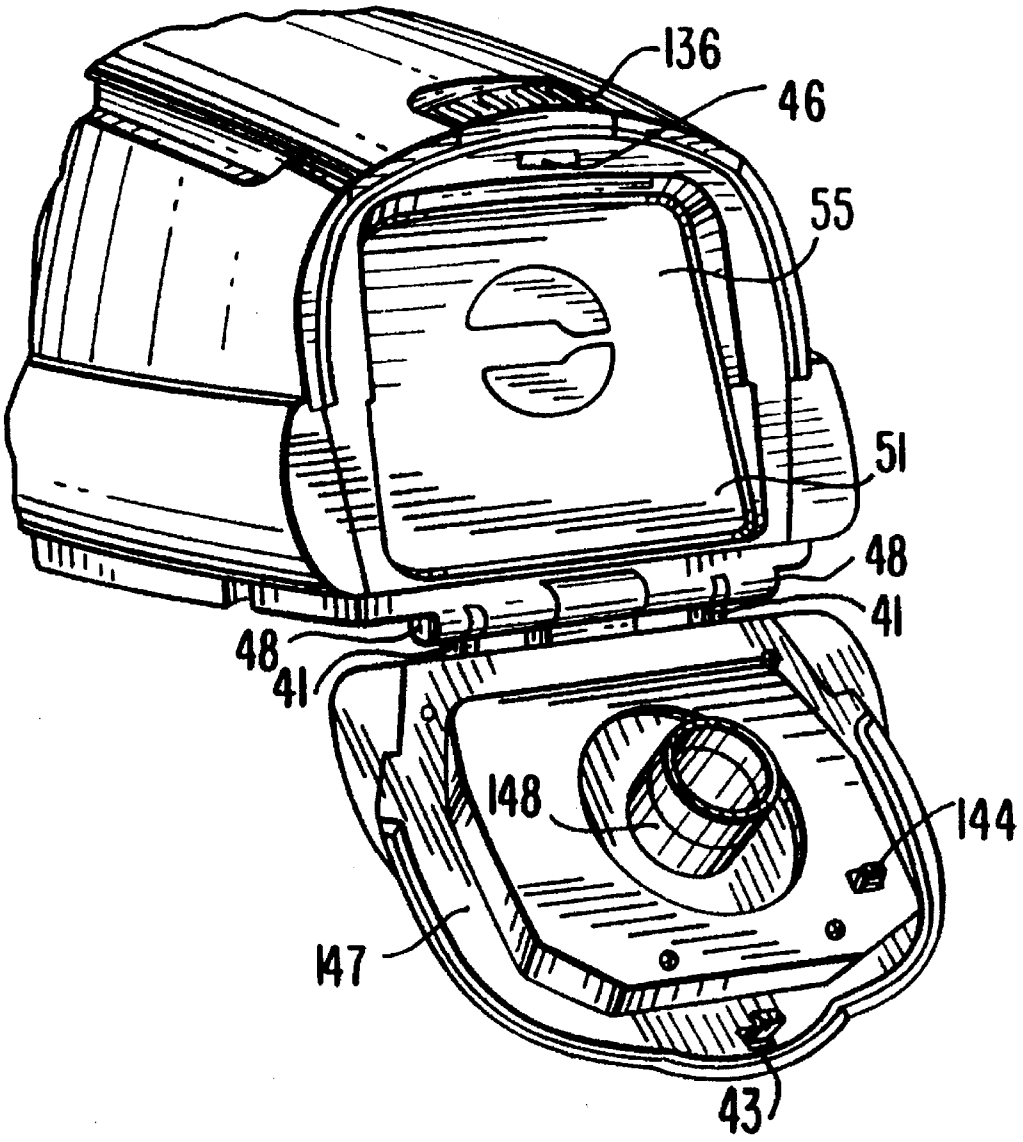
FIG. 10 is a perspective view of the vacuum cleaner of FIGS. 1–5 with the front door assembly of FIGS. 8 and 9 unlatched and open.

A one-piece innerbody 50, also preferably molded of polypropylene, is placed inside the innerbody compartment 21. The one-piece construction of the innerbody 50 prevents air-leaks from the innerbody 50 to the surrounding areas. A vacuum bag 51 is placed inside innerbody 50, with the front panel 55 of bag 51 lying flush with the opening of innerbody 50, as illustrated in FIG. 10.

A series of vanes 52 are integrally molded around the inside surface of innerbody 50. When vacuum bag 51 is loaded in innerbody 50, vanes 52 prevent the bag 51 from sealing against the sides of the inside of innerbody 50. Vanes 52 serve to provide air gaps between bag 51 and the inside walls of innerbody 50, providing an even distribution of suction air to all sides of vacuum bag 51, and ensuring maximum airflow out of innerbody 50.

Similarly, a series of vanes 53 are integrally molded on the portion of the inside surface of shell 20 which forms the innerbody compartment 21. Vanes 53 serve to space the lower surface of innerbody 50 from the inner surface of shell 20, so that air may be introduced through air bleed opening 125 when necessary.

Motor assembly 220, comprised of a motor 222 and a motor cowl 221, is located immediately behind innerbody 50. A rubber boot 54, connected to the back of innerbody 50, serves to direct air from innerbody 50 to motor assembly 220.

Motor cowl 221, preferably molded of thermoplastic rubber, is assembled around motor 222. An opening in the bottom of motor cowl 221 and a series of shell ribs 224, integrally formed in motor compartment 22, serve to redirect the exhaust air through a series of 180° turns, thereby reducing the noise produced by the airflow. Ribs 224 also serve as a motor support, spacing the motor 222 away from the shell 20, thereby insulating shell 20 from vibrations caused by motor 222.

Outer cowl assembly 328 is placed on top of, and forms an airtight seal with, the rear portion of motor cowl 221 and motor compartment 22. Exhaust air exiting from motor cowl 221 is thereby forced to enter a cavity formed by outer cowl 332 and shell 20.

With innerbody 50, motor assembly 220, and cord reel assembly 434 mounted on lower shell 20, upper shell 30 is affixed to, and forms and airtight seal with, lower shell 20, forming vacuum cleaner body 15. Main wheel assemblies 120, preferably made of acetal or nylon, comprise bearings 121, integrally formed with wheel hubs 111, and wheel tires 122. Assemblies 120 are snapped into openings provided in the underside of shell 20. The openings for assemblies 120 are preferably provided along a main wheel axis 126, which preferably intersects, and is perpendicular to a longitudinal axis 128, adjacent the center of gravity 127 of vacuum cleaner 10.

A front caster assembly 123, comprising an integrally molded bearing and journal 116 and a front caster wheel 119, is also attached to the underside of shell 20, adjacent the front end of vacuum cleaner 10. Assembly 123 is pressed into an opening in shell 20 from the bottom. Bearing and journal 116 preferably rotate about a steering axis 129, which is substantially vertical and substantially perpendicular to longitudinal axis 128. Wheel 119 preferably rotates about caster wheel axis 118, which is preferably substantially horizontal and substantially perpendicular to and offset from steering axis 129.

When vacuum cleaner 10 is pulled straight forward, caster wheel axis 118 is parallel to main wheel axis 126. However, when vacuum cleaner 10 is pulled in a direction oblique to the longitudinal axis—i.e., towards one side or the other—bearing and journal 116 rotate wheel 119 about steering axis 129, so that axis 118 is no longer parallel to main wheel axis 126. In this situation, body 15 is made to pivot about a pivot axis 117, which is perpendicular to and intersects longitudinal axis 128 adjacent center of gravity 127.

Two rear casters assemblies 124, similar to assembly 123, comprise bearings and journals 115 and caster wheels 114, and are mounted on the underside of shell 20, substantially toward the rear end of body 15. Caster assemblies 124 are also pressed into openings in shell 20 from the bottom. As described in relation to assembly 123, when vacuum cleaner 10 is pulled in a direction oblique to the longitudinal axis, bearings and journals 115 rotate wheels 114 in a direction opposite that taken by wheel 119.

Assemblies 124 may also provide additional stability to vacuum cleaner body 15, particularly when the power cord 433 is rewound. When the use of vacuum cleaner 10 is concluded, the user may depress cord rewind lever 431, causing power cord 433 to be rewound automatically, whether with his or her foot, or by hand. Because main wheels 122 are located forward of lever 431, the pressure applied by the user might cause body 15 to pivot about main wheel axis 126, so that the rear end touches the floor. The presence of assemblies 124 substantially underneath lever 431 prevents body 15 from rocking or tipping over, when lever 431 is actuated by the user.

Also formed in the underside of shell 20, slightly forward of main wheel assemblies 120, are two air bleed openings 125. Ambient air is automatically introduced through openings 125 to prevent an overheat condition when needed.

Figure 7:
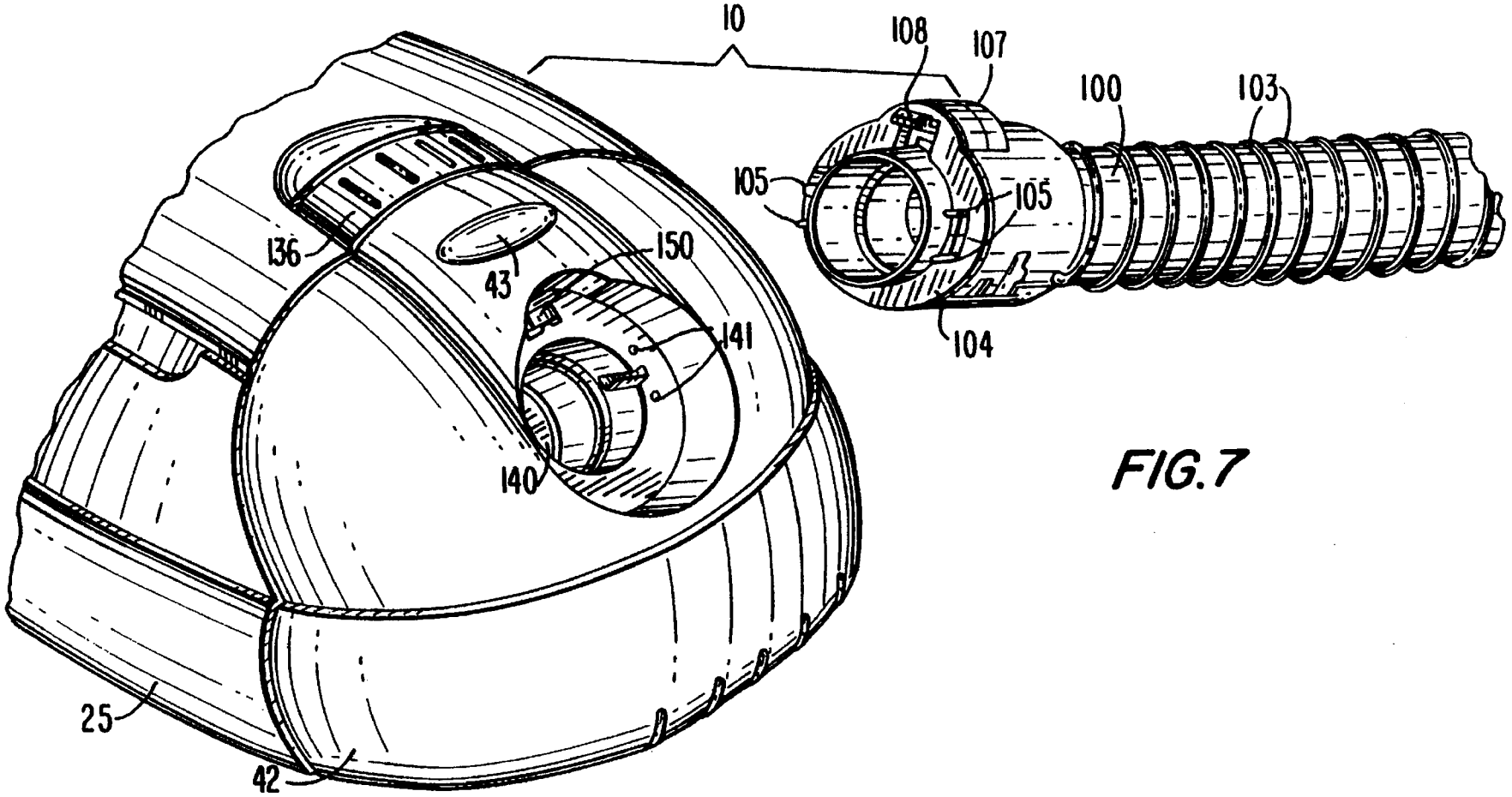
FIG. 7 is a perspective view of the other end of the hose assembly of FIG. 6 and the front end of the vacuum cleaner of FIGS. 1–5.

As illustrated in FIGS. 7 and 10, the front end of body 15 is closed by a door assembly 40, into which is formed a suction port 140.

A door hinge 41 is integrally formed at the base of door assembly 40. A front bumper 42 is mounted on the lower portion of door assembly 40, above door hinge 41, spanning the width of door assembly 40 from one side to the other. Bumper 42, preferably made from PVC, is preferably a two-piece assembly, with the PVC bumper 42 being overmolded over a foamed polypropylene shell. Bumper 42 provides cushioning, while the shell provides strength.

Bumper strips 25, 26, however, preferably attached to both sides and the rear of lower shell 20, are preferably "balloon-type" bumpers having a hollow air chamber 44, for absorbing the forces of impacts between vacuum cleaner 10 and, e.g., a wall or furniture.

Figure 9:
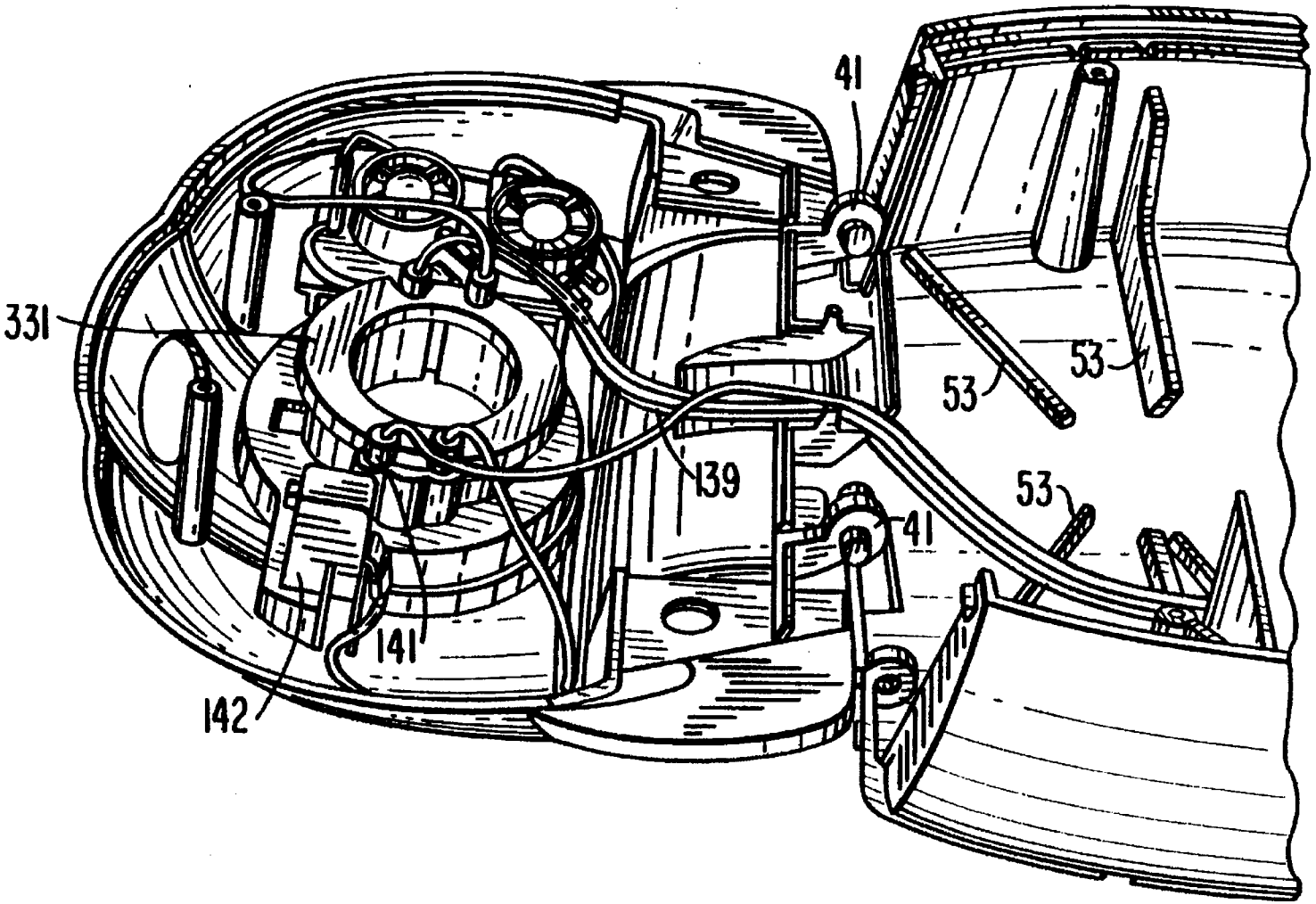
FIG. 9 is a perspective view of the interior of the front door assembly of FIG. 8.

Suction port 140 is preferably formed substantially in the center of door assembly 40, above bumper 42. A door latch 43 is preferably formed above suction port 140. Female electrical connectors 141 are preferably provided in suction port 140, for connection with the male electrical connectors 105 provided in assembly 104 of hose 100, as described above, in connection with blowport 330. As can be seen in FIG. 9, in the preferred embodiment, the electrical connectors 141 are attached to four electrical wires 139 for conducting electrical power and signals from the hose 100 to an actuation circuit.

Figure 8:
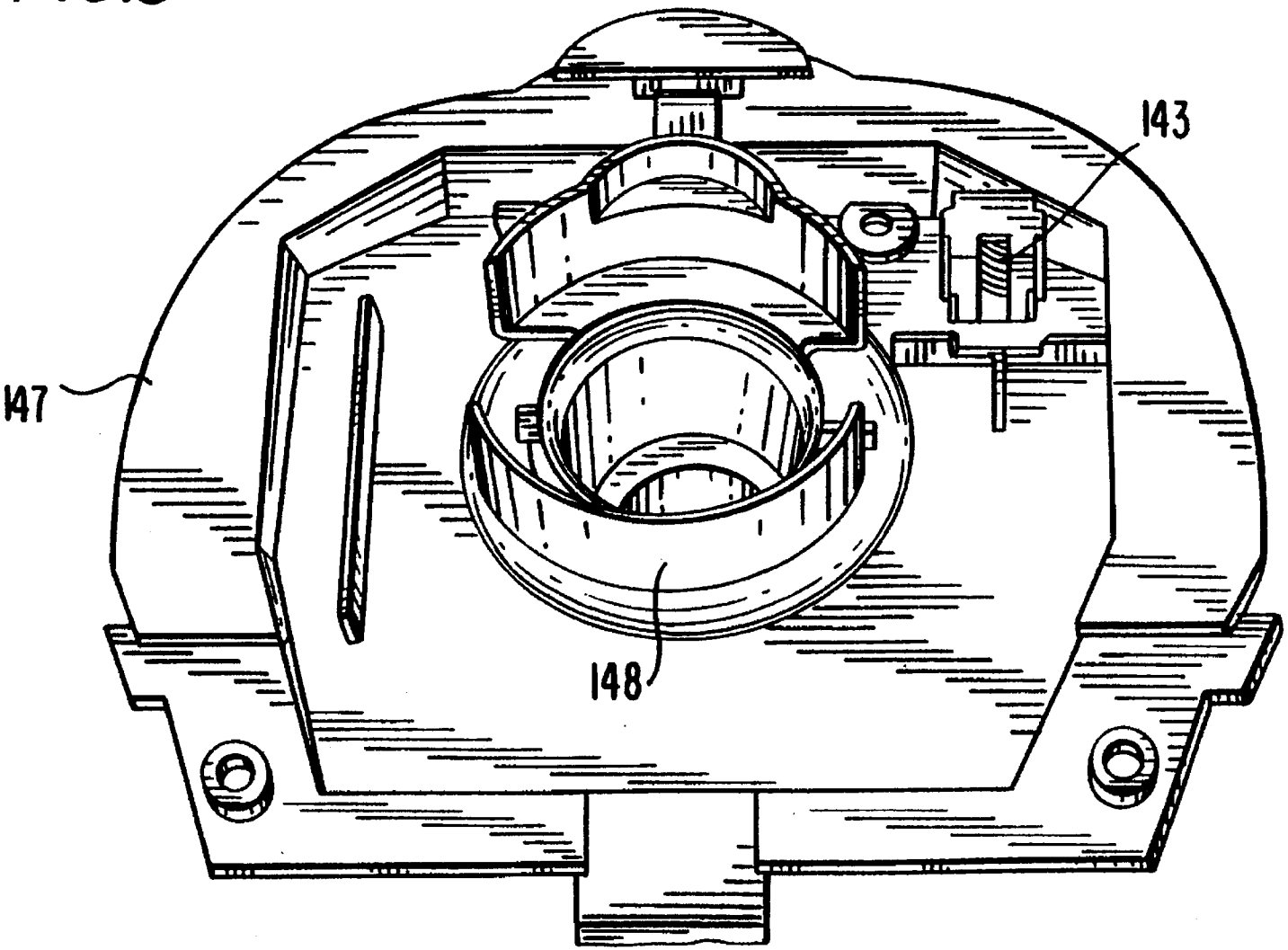
FIG. 8 is an elevational view of the front face of the rear plate of the front door assembly of the vacuum cleaner of FIGS. 1–5.

As can be seen in FIGS. 8–10, a no-bag lockout switch 142 is mounted on door assembly 40. Lockout actuator 144 is biased outward by spring 143. When a vacuum bag 51 is loaded in the cleaner as illustrated in FIG. 10, and the front door assembly 40 is then locked into place, the front panel 55 of vacuum bag 51 is forced against and depresses actuator 144 which serves to close switch 142. Similarly, actuator 144, by virtue of spring 143, is pressed against vacuum bag 51, with a continuous force which seeks to keep the bag 51 in a proper position against innerbody 50.

As illustrated in FIGS. 8 and 10, a front door cover plate 147, is attached to, and covers, the back side of front door assembly 40. Cover plate 147 serves to house electrical contact ring 331, electrical connectors 141, switch 142 and any other control elements that may be included in front door assembly 40, as described in copending, commonly-assigned U.S. patent application Ser. No. 08/241,578, filed concurrently with the parent hereof, and hereby incorporated by reference in its entirety.

As illustrated in FIG. 5, hinge compartments 24 are integrally molded into the inside of the front end of lower shell 20. Compartments 24 are designed to receive door hinges 41. Lips 49 on the underside of innerbody 50 are designed to cover compartments 24, after hinges 41 are inserted therein, ensuring that hinges 41 remain in place. In this manner, front door assembly 40 is rotatably connected to shell 20, and may be pivoted away from body 15 about a hinge axis 48, illustrated in FIG. 10. The upper portion of door assembly 40 is connected to innerbody 50 by door latch 43, which fits into front door notch 46, illustrated in FIG. 10.

A suction port tube 148, preferably made of ABS, fits over the electrical connectors 141 and passes through an opening formed in plate 147. A seal 151 is then placed over tube 148. When vacuum cleaner 10 is in use, the back end of tube 148 pierces vacuum bag 51, with seal 151 resting against the front side of the center of panel 55 of bag 51, preventing the leakage of suction produced by blower 222, so that a maximum portion of the suction is transmitted to suction port 140 and thence through hose 100.

A hose assembly 100, illustrated at FIGS. 6, 7 and 13, is preferably connected to body 15 at either of ports 140, 330. One end of hose 100 comprises a hose handle 101, preferably molded from ABS. Handle 101 preferably includes electronic controls located under a control panel 102 for operating cleaner 10. One preferred embodiment of an electronic control system for vacuum cleaner 10 is more fully described in above-incorporated application Ser. No. 08/241,578.

Electrical power and control signals preferably are conducted to control panel 102 through electrical conductors 103 preferably in hose 100. In the embodiment illustrated in FIGS. 1–13, four electrical conductors are provided. However, any number of conductors may be provided.

A hose attachment assembly 104 is provided at the end of hose 100 remote from handle 101, for attachment to either the suction port 140 or blowport 330 of vacuum cleaner body 15. The four electrical conductors 103 in hose 100 terminate in four male electrical connectors 105, which protrude from hose attachment assembly 104.

Assembly 104 also comprises a hose attach and release mechanism. Button 107, which protrudes from one side of assembly 104, is integrally attached to notched lever 108, which protrudes from the end of hose 100 that may be attached to ports 140, 330. Lever 108 is biased against the end of notch 109 remote from the center of hose 100 by one or more springs.

When hose 100 is to be attached to either port 140 or port 330, button 107 is depressed by the user, forcing lever 108 down toward the center of the opening of hose 100 Hose 100 can then be inserted in either port 140, 330 and lever 108 will clear notches 150, 339, in suction port 140 and blowport 330 respectively. When button 107 is released, lever 108 is forced by springs 110 (not shown) back into its original position. In this position, lever 108 interferes with notches 150, 339, and hose 100 can not be removed from whichever of ports 140, 330 it is attached to, until button 107 is pressed again.

During normal operation of vacuum cleaner 10, in which the hose 100 is connected to suction port assembly 140, exhaust air will be directed out of vacuum cleaner 10 through exhaust cavity 130, and blowport 330 will be closed. This is accomplished by outer cowl assembly 328, comprised of outer cowl 332 and diverter valve 334. Diverter valve 334, which is connected to outer cowl 332, is biased outward by one or more integrally formed springs 339. The first end 335 of valve 334, which lies near auxiliary hole 333, is circular, and is substantially the same size and shape as hole 333. The second end 340 of valve 334, which is door-shaped, and which lies near opening 336, is substantially the same size and shape as opening 336.

In its normal position, first end 335 of valve 334 blocks auxiliary hole 333, formed in the top of cowl assembly 332. In this position, second end 340 of valve 334 is spaced away from opening 336, and exhaust air out is thereby directed out of cowl assembly 332 therethrough. In this manner, exhaust air is prevented from exiting blowport 330 when the hose is connected to suction port 140.

In this normal mode, a blowport cover 337 is maintained in a closed position over blowport 330. A raised bump 338 formed on cover 337 provides the user with a visual clue of the location of the blowport in this position.

When hose 100 is connected to suction port 140, motor 222 draws air from hose 100, through suction port 140 and through vacuum bag 51. The air flow then exits from bag 51 and out through the rear of innerbody 50 and into motor 222. Motor cowl 221 redirects the air through a series of 180° turns, described above, and then directs the air flow into outer cowl assembly 332, except for a small bleed flow which is directed to the cord compartment. Outer cowl assembly 332 then directs the air flow through opening 336, towards the front of body 15, where it is forced up and around innerbody 50. Finally, the air flows into cavity 130, up through filter 132, tool grill 133 and out around the edges of cover 135.

When a source of pressurized air is desired, cover 337 may be lifted, and hose 100 may be connected to blowport assembly 330. In this mode, motor 222 still draws air through suction port 140 and through vacuum bag 51. As above, the air flow then exits from bag 51 and out through the rear of innerbody 50 and into motor 222. Similarly, motor cowl 221 redirects the exhaust air through a series of 180° turns, described above, and then directs the air flow into outer cowl assembly 332, except for the small bleed flow, which is directed to the cord compartment.

However, when the hose 100 is connected to blowport 330, first end 335 of diverter valve 334 is depressed by hose 100, opening blowport 330. Second end 340 of diverter valve 334 is similarly urged into opening 336, closing the path through outer cowl assembly 332 to exhaust cavity 130 normally taken by the exhaust air. In this mode, outer cowl assembly 328 directs the exhaust air up and out of blowport 330, through hose 100, thereby providing a source of pressurized air. Thus, exhaust air can only be directed through the blowport 330 when the hose is connected to blowport 330, instead of suction port 140.

Thus it is seen that an improved arrangement for a canister-type vacuum cleaner is provided in which an exhaust vent of increased size is located on the same side of the vacuum cleaner's motor as the suction port, thereby decreasing the volume of the noise produced by the vacuum cleaner.

It is also seen that various operations of the vacuum cleaner can be remotely controlled by the user from the remote end of the hose, whether the hose is connected to the suction port or the blowport.

Finally, it is seen that a vacuum cleaner with improved maneuverability is provided, in which two or more wheels are located along an axis passing substantially adjacent the vacuum cleaner's center of gravity and a caster located toward the front end of the canister, shortening the wheelbase of the vacuum cleaner, and allowing it to rotate in smaller spaces. Additional casters may also be provided toward the rear of the cleaner for added stability.

One skilled in the art will appreciate that the present invention can be practiced by other than the described embodiments, which are presented for the purposes of illustration and not of limitation, and the present invention is limited only by the claims that follow.

What is claimed is:

1. A vacuum cleaner comprising:

a body having a front end from which said body is pulled along a surface on which it rests, a rear end opposite said front end, a center of gravity between said front end and said rear end, an underside adjacent said surface, a longitudinal axis running from said front end to said rear end, a steering axis adjacent said front end and substantially perpendicular to said longitudinal axis and said surface, and a main wheel axis substantially perpendicular to said longitudinal axis, substantially parallel to said surface, and adjacent said center of gravity;

at least two wheels mounted on said underside of said body for rotation about said main wheel axis; and a caster mounted on said underside of said body, adjacent said front end, for rotation about said steering axis, said caster having a caster wheel axis perpendicular to said steering axis and having a caster wheel mounted for rotation about said caster wheel axis;

at least one additional caster mounted on said underside of said body adjacent said rear end; whereby:

when said vacuum cleaner is pulled parallel to said surface in a direction oblique to said longitudinal axis, said body pivots about a pivot axis substantially parallel to said steering axis and passing through said wheel axis.

2. The vacuum cleaner of claim 4 wherein each of said wheels is molded from a polymeric material, each of said wheels having integrally molded journals.

3. The vacuum cleaner of claim 2 wherein said caster wheel axis is spaced away from said steering axis.

4. The vacuum cleaner of claim 1 wherein said at least one additional caster comprises two additional casters mounted on said underside of said body adjacent said rear end.

5. The vacuum cleaner of claim 1 wherein said body has an upper side opposite said underside, said vacuum cleaner further comprising at least one control mounted on said upper side of said body adjacent said rear end for actuation by downward force exerted by a user, said at least one additional caster preventing said body from pivoting about said wheel axis when said user exerts said force to actuate said control.

* * * * *

UNITED STATES PATENT AND TRADEMARK OFFICE

CERTIFICATE OF CORRECTION

PATENT NO : 5,638,573

DATED : June 17, 1997

INVENTOR(S) : Michael F. Martin et al.

It is certified that error appears in the above-identified patent and that said Letters Patent is hereby corrected as shown below:

Column 1, line 4, "1994" should be -- 1994, --.

Column 5, line 41, "air-leaks" should be -- air leaks --.

Column 6, line 14, "and" (second occurrence) should be -- an --.

Column 7, line 37, after "against" should be inserted -- the --;

line 46, "patent application Ser." should be -- Patent Application --.

Column 8, line 10, "application Ser." should be -- Application --;

line 32, "100" (first occurrence) should be -- 100. --.

Column 9, line 4, "air flow" should be -- airflow --;

line 7, "air flow" should be -- airflow --;

line 16, "air flow" should be -- airflow --;

line 19, "air flow" should be -- airflow --;

Claim 2, column 10, line 34, "4" should be -- 1 --;

Signed and Sealed this

Twenty-first Day of December, 1999

*Attest:*

Q. TODD DICKINSON

*Attesting Officer*

*Acting Commissioner of Patents and Trademarks*